United States Patent [19]

Yando

[11] 3,936,984

[45] Feb. 10, 1976

[54] INSULATED AIR INFLATED STRUCTURES

[76] Inventor: Stephen Yando, 315 W. 57th St., Apt. 16A, New York, N.Y. 10019

[22] Filed: Oct. 28, 1971

[21] Appl. No.: 193,273

[52] U.S. Cl. ..... 52/2
[51] Int. Cl.[2] ..... E04B 1/345
[58] Field of Search ..... 52/2

[56] References Cited

UNITED STATES PATENTS

| | | | |
|---|---|---|---|
| 2,649,101 | 8/1953 | Salts | 52/2 |
| 2,934,075 | 4/1960 | Richardson | 52/2 |
| 3,042,050 | 7/1962 | Finlayson | 52/2 |
| 3,161,553 | 12/1964 | Visser | 52/2 |
| 3,229,429 | 1/1966 | Conrad | 52/2 |
| 3,249,682 | 5/1966 | Laing | 52/2 |
| 3,257,481 | 6/1966 | Ming-Yang Chang | 52/2 |
| 3,304,664 | 2/1967 | Duquette | 52/2 |
| 3,389,510 | 6/1968 | Stock | 52/2 |
| 3,390,491 | 7/1968 | Hayden | 52/2 |
| 3,660,951 | 5/1972 | Cadwell | 52/2 |
| 3,742,657 | 7/1973 | Price | 52/2 |
| 3,779,847 | 12/1973 | Turne | 52/2 |

FOREIGN PATENTS OR APPLICATIONS

| | | | |
|---|---|---|---|
| 539,712 | 6/1955 | Belgium | 52/2 |

*Primary Examiner*—Ernest R. Purser
*Assistant Examiner*—Henry Raduazo
*Attorney, Agent, or Firm*—Stefan J. Klauber, Esq.

[57] ABSTRACT

An air inflated structure, the outer shell walls of which have a surface geometry consisting of one or more concave sections. Heat flow from or into the enclosed volume is drastically curtailed by thin plastic films, which are secured to the outer boundaries of the concave surface sections, and are joined to the shell wall at locations within the boundaries of its curved surface section by direct attachment or via flexible anchor tie strips.

The surface area of each film is less than that of the surface geometry encompassed within the boundary to which it is secured, whereby in its inflated state, the outer shell wall extends the films in a taut fashion across its curved surface geometries to define a thin, uniform and dimensionally stable insulating air space between the shell wall and the plastic films. Additional sets of plastic films, spaced approximately parallel, may be utilized to further curtail the said heat flow.

16 Claims, 7 Drawing Figures

INVENTOR.
STEPHEN YANDO

BY Stephen J. Klauber
ATTORNEY.

INVENTOR.
STEPHEN YANDO

BY Stefan J. Klauber
ATTORNEY.

*INVENTOR.*
STEPHEN YANDO

*BY* Stefan J. Klauber
*ATTORNEY.*

INSULATED AIR INFLATED STRUCTURES

BACKGROUND OF THE INVENTION

This invention relates generally to air inflatable structures and more specifically relates to air inflatable structures incorporating means to limit the heat flow into and out of the space thereby enclosed.

In recent years, a variety of causes have combined to provide a very high order of interest in so-called air-inflated structures. These structures are essentially a flexible shell, formed, for example, of tough plastic material, such as for example, a nylon or dacron cloth impregnated with a vinyl or vinyl residue, which shell is maintained in an inflated, expanded condition by a positive air pressure, supplied within the space thereby covered, as for example by simple air-pumping means. In part, the said structures have become practical, and, therefore, increasingly used, because of the development of the type of plastic materials which lend themselves to the structures represented. However, there are more basic causes for the increased popularity of the structures, such as for example, the ever-increasing cost of constructing permanent frame buildings, and the fact that structures of the inflatable type may be set up and put to work performing their function within a matter of hours as opposed to weeks or months, as is the case with more permanent structures. The inflatable structures have moreover become of increasing interest because of their ready adaptability to use in enclosing recreational facilities, such as for example tennis courts and swimming pools. Such recreational facilities have come into increasing and more widespread use within recent years and a consequent increase in interest has occurred with respect to coverings enabling use of such recreational facilities on a year-round basis.

In this latter connection, it may be noted that one of the most significant shortcomings presently limiting what would otherwise be an even more wide-spread use of inflatable structures, is the fact that such structures are notoriously ineffective in restraining heat transmission into and out of the thus enclosed space. This unfortunate occurrence is basically due to the fact that a space enclosed by the said structures is separated from the ambient environment only by the thin wall of the inflated structure. The consequent, inordinately high heat transmission co-efficient for the stucture, makes the heating and air-conditioning of the enclosed space both difficult and very expensive. Troublesome condensation also arises when the moist, warm interior air contacts the cold, thin wall of the air structure. These factors negate much, if not all, of the economic advantages of utilizing such a structure in those many cases where heating or air-conditioning is a requirement.

In accordance with the foregoing, it may be regarded as an object of the present invention to provide air-inflated structures wherein the heat transmission through the walls thereof is so severely diminished that the structures may be economically heated and air-conditioned.

It is another object of this invention to provide air-inflated structures wherein the tendency for moisture condensation upon the walls thereof is so severely diminished that a comfortable environment is provided within the structure.

It is a further object of the present invention to provide air-inflated structures which include means for insulating the walls thereof against heat flow into and out of the enclosed space, which insulating means are provided in a simple and inexpensive manner and by the addition of relatively little weight to the basic structure.

It is a still further object of the present invention to provide a construction for insulating air-inflatable structures, which is particularly adaptable to the sculptured type inflatable structures utilizing shroud lines, and which when incorporated into such structures provides a highly effective and low-cost insulation against heat transmission into and out of the enclosed space.

It is yet an additional object of the present invention, to provide a construction for insulating the walls of inflatable structures, which readily lends itself to mass production techniques and which adds little cost and very little weight to the walls of such inflatable buildings.

SUMMARY OF INVENTION

Now in accordance with the present invention, the foregoing objects, and others as will become apparent in the course of the ensuing specification, are achieved through use of thin plastic films so secured to the inner walls of the inflatable structures as to provide one or more thin layers of dead air space between the walls and the enclosed space. The thin plastic films are secured to the boundaries of the basic surface geometries comprising the shell walls and are joined to the shell wall at locations within the boundaries of its curved surface geometries by direct attachment or via flexible anchor tie strips, whereby in its inflated state the outer shell wall extends the film in relatively taut fashion across its curved surface geometries to define a thin, uniform and dimensionally stable insulating air space between wall and film. Plural sets of plastic film, spaced approximately parallel, may be utilized to further curtail the said heat flow by thus providing a plurality of thin insulating air spaces.

BRIEF DESCRIPTION OF DRAWINGS

The invention is diagrammatically illustrated, by way of example, in the drawings appended hereto in which.

DESCRIPTION OF PREFERRED EMBODIMENT

Figure 1:
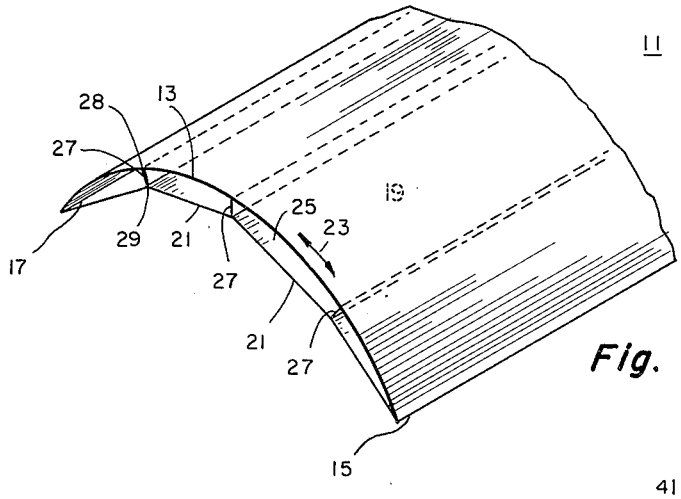
FIG. 1 is a schematic diagram illustrating the basic principles of the present invention as applied to a cylindrically shaped portion of an inflatable structure.

In FIG. 1, a diagram appears illustrating the basic principles of the present invention as applied to a cylindrically shaped portion of an inflatable structure. In connection with this figure, it should be appreciated that the showing is highly schematic in nature and is not intended to depict details of the structure, which will rather appear and be further described herein below.

In FIG. 1, a generally cylindrically shaped concave section 11 of an inflatable structure is set forth. Section 11 may be regarded as a comparatively large portion of an inflated structure, as for example the arched roof of an inflatable structure enclosing a tennis court or the like; or alternatively, the section 11 may be considered as merely representing a small element of an inflated structure, as for example, a billowing section defined between a pair of shroud lines which might thus be present at the edges 15 and 17 of the section. Section 11, in any event, is in its inflated, expanded condition, with the skin 13 displaced to its fully expanded state by positive air pressure provided within the space 19. The skin 13, even as apparent in the present schematic showing, comprises a single layer of tough, flexible cloth-like material, typically a nylon or dacron cloth impregnated with vinyl or a vinyl residue.

In accordance with the principles of the present invention, a thin plastic film 21 is secured to the edges 15 and 17 of section 11. Thus, specifically, the film 21 which is typically a continuous film of polyvinyl chloride or similar thermoplastic material, and has a thickness typically of the order of 2 mils, is secured, as for example, by heat sealing to skin 13 along the edges 15 and 17. The width of film 21 of section 11 extending between edges 15 and 17 is of shorter dimension than the width of the skin 13 of section 11. The film 21 is secured to skin 13 at locations intermediate to the edges 15 and 17 via flexible anchor tie strips 27. Thus, the film 21 is heat sealed to lateral edge 29 of tie strip 27 while the opposite lateral edge 28 of tie strip 27 is heat sealed to the skin 13. The anchor ties 27 typically may comprise a thermoplastic thin material, such as for example, the same polyvinyl chloride film as is used for film 21. As a consequence of this structural arrangement, it is apparent that when the section 11 is in its inflated or expanded condition, the film 21 will be extended in a relatively taut fashion as shown in FIG. 1 between edges 15 and 17 and will establish a surface approximately parallel to the skin 13 and spaced therefrom by a distance approximately equal to the transverse width of the anchor tie strips 27. By such extension of film 21, a relatively thin and uniform air space 25 is established between the skin 13 and film 21 which provides effective insulation that severely inhibits the flow of heat through the air structure walls. It is pointed out at this time that the tie strips 27 are not essential features of this invention since the film 21 could in some instances be directly heat sealed to the skin 13 without too much loss of overall insulating efficiency. The tie strips 27 are useful and desireable however since they (a) inhibit the heat loss and moisture condensation that would otherwise occur in the attachment regions (b) they permit the establishment of uniform air spaces of any desirable thickness and (c) they facilitate the storage and handling of the deflated air structure by permitting the flat folding of the outer skin 13, unrestrained by the smaller dimensions of the film 21. For this reason, tie strips will generally be employed in the preferred embodiments hereinafter described but should not be construed as limiting the scope of the invention.

Figure 2:
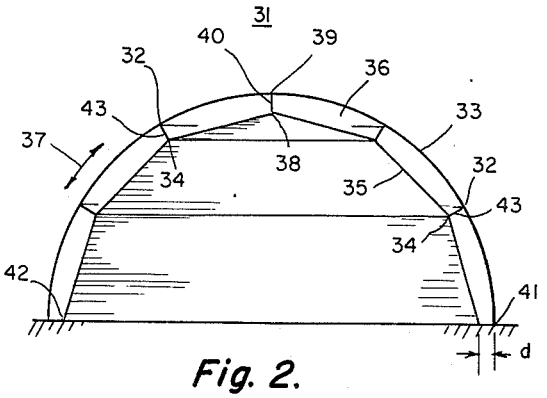
FIGS. 2 and 2*a* are schematic diagrams similar to FIG. 1, setting forth the principles of the invention as applied to part of a spherically shaped inflated structure.
Figure 2A:
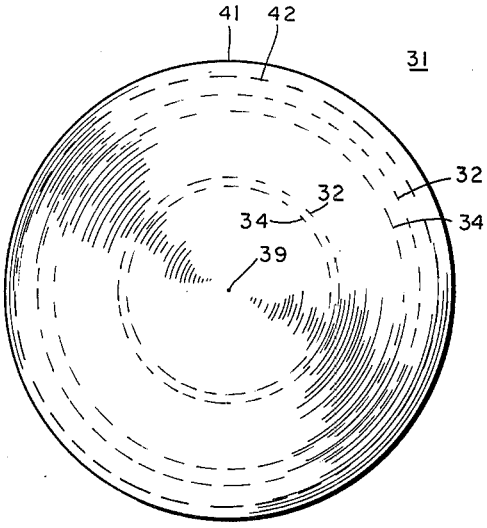

FIGS. 2 and 2*a*, similar to FIG. 1, set forth in highly schematic fashion the manner in which the principles of the present invention are applied to a spherical concave section 31 of an inflated structure. The section 31 in this case may be regarded either as a complete air inflated structure or alternatively as a very limited section of the structure in question.

In the present instance, the spherical skin 33 of the inflated structure is secured to the base of the structure along perimeter 41. A thin film 35 is secured to the spherical skin 33 in a manner similar to that discussed in connection with FIG. 1. More specifically, a generally spherically shaped film 35, whose radius of curvature is somewhat less than that of the spherical skin 33, is secured at the base of the structure along the perimeter 42 and separated from the skin by a small distance d. The highest point 38 of the film 35 is secured to the highest point 39 of the skin 33 by a short filamentary anchor tie 40. Additionally, anchor tie strips 43 are employed at the two intermediate locations shown. The plastic film 35 is heat sealed to the anchor tie strips 43 along the edges 34 while the skin 33 is heat sealed to the tie strips along the edges 32. When the skin 33 is in its inflated condition, it will extend the plastic film 35 into a relatively taut surface which will be spaced from the outer skin 33 by a distance determined by the anchor ties. In this manner, air spaces 36 will be created between the film 35 and the skin 33 which will restrict the heat flow from or to the enclosed volume.

Figure 3:
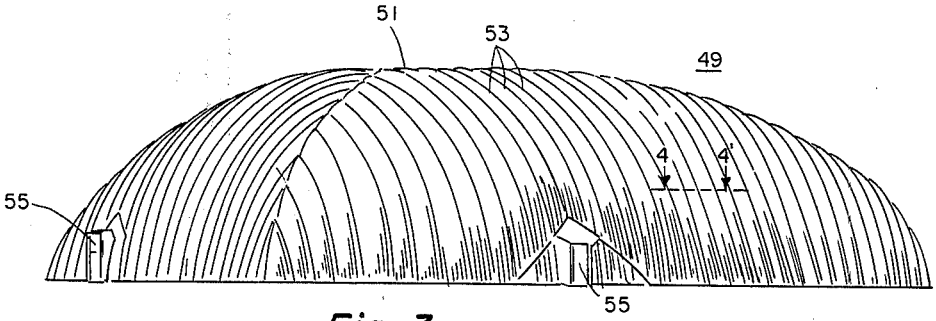
FIG. 3 is an isometric depiction of a sculptured structure with which the present invention may be employed.

In FIG. 3, an isometric view appears of an inflated structure 49 particularly suited for use with the present invention. To the extent shown in FIG. 3, the external aspects of structure 49 are conventional and are merely set forth herein in order to concretely provide an understanding of the present invention. The structure 49 thus includes an inflated shell 51, the outer skin of which typically comprises the relatively tough, impregnated cloth previously referred to. Structure 49 is of the so-called "sculptured" type, which utilizes a plurality of shroud lines 53, which are drawn about the inflated structure and act to relieve stress in the expanded skin. As is known in the art, the structure 49 also includes a number of entrance and exit ports, such as at 55, which are usually of the revolving door type so as to include appropriate seals for aiding in retention of positive air pressure within the structure.

Figure 4:
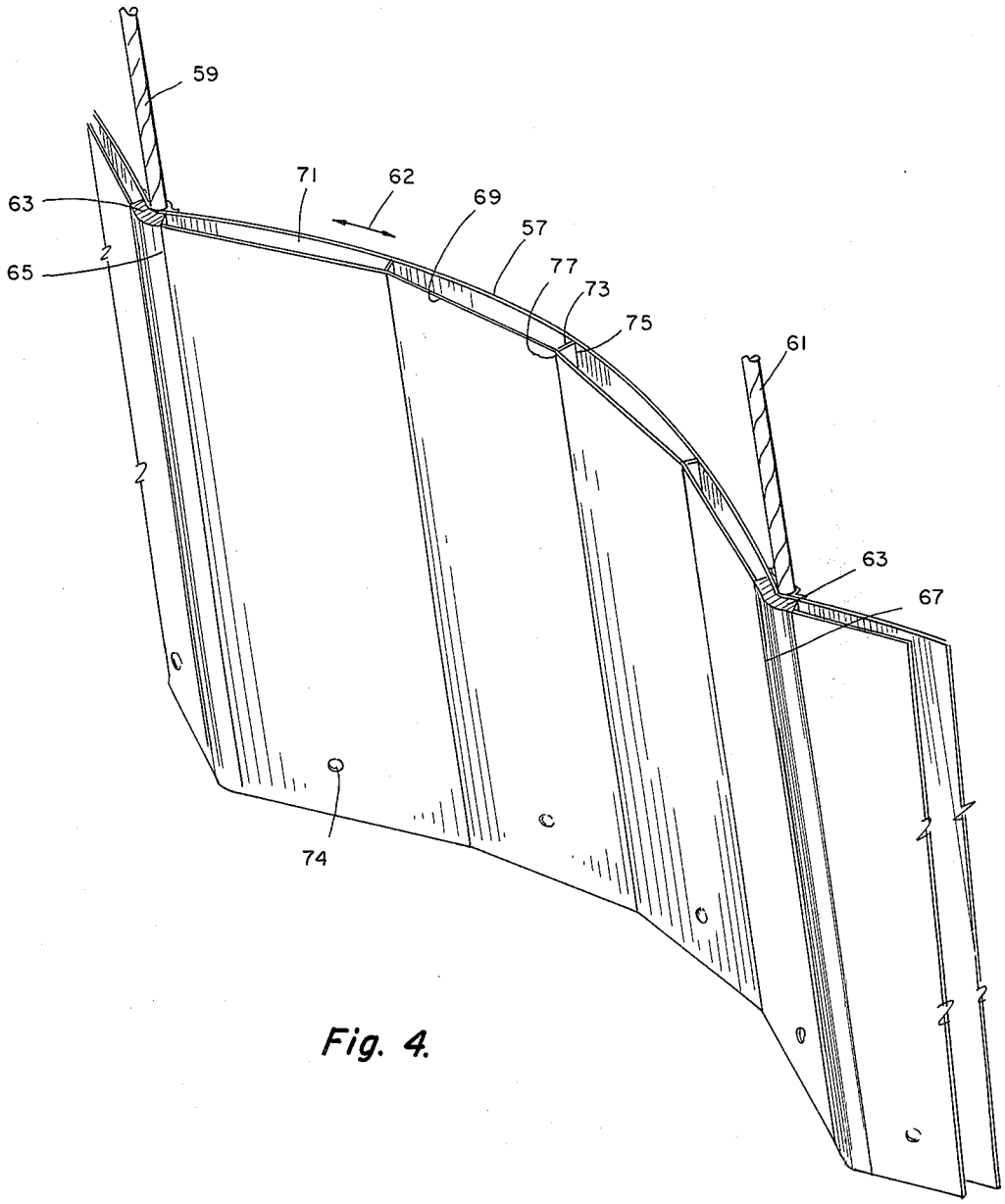
FIG. 4 is a fragmentary partially sectional view through the wall of the FIG. 3 structure, taken along the line 4–4′ and illustrates arrangement of the components utilized in the invention.

In FIG. 4, a fragmentary, partially sectioned view appears through the wall of the structure of FIG. 3. The view is taken along the line 4–4′ of FIG. 3, and illustrates the arrangement of the components utilized in the invention. As seen therein, the relatively thick skin 57 of the inflated structure extends between a pair of shroud lines 59, 61. Because of the positive air pressure within the structure, the skin 57 is seen to be displaced into a billowing arc 62 extending between the said shroud lines. Positioned against the inner side of skin 57 are film-shroud line anchor strips 63 which extend in parallel fashion to the shroud lines, and may be formed of a flexible plastic, as for example polyvinyl chloride. Strip 63 has a thickness of the order of one-half inch and is preferably heat-sealed or otherwise secured to skin 57 at the side adjacent thereto. At the opposite sides of strips 63, a thin plastic film 69, comprising for example a 2 mil polyvinyl chloride or similar thermoplastic material, is heat sealed to strips 63 along the lines such as 65 and 67. The film 69 is continuous along its extension between lines 65 and 67, and in accordance with the principles of the invention previously set forth, is between such boundary lines of lesser extension than is the length of arc 62 defined by skin 57 between shroud lines 59 and 61.

The film 69 is attached to the skin 57 along lines intermediate to the shroud lines 59 and 61, via the anchor tie strips 73 which typically comprise a thin, flexible thermoplastic material similar or identical to that utilized for film 69. The inner lateral edge 77 of the ties 73 is secured to the film 69 as by heat sealing while the outer lateral edge 75 is in like manner secured to the skin 57. In consequence of the structural arrangement described in FIGS. 3 and 4, it will be evident that when skin 57 is fully expanded due to positive air pressure within the structure 49, the thin film 69 will be extended in relatively taut fashion between 65 and 67 thereby sandwiching a thin, uniform and dimensionally stable dead air space 71 between the skin 57 and the thin film 69. It is, of course, this dead air space 71 which in accordance with the invention provides the highly effective insulation which limits the heat flow into and out of the structure 49. In order to provide venting to allow the pressure within the dead air space 71 to equalize to that within the air structure under all circumstances, as during inflation and due to heating effects, a plurality of small venting holes 74 are provided in the film 69.

Figure 5:
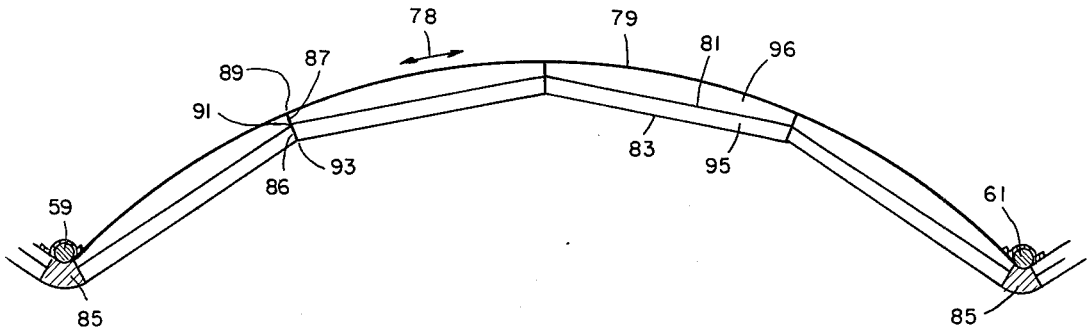
FIG. 5 is a cross-sectional view through a wall structure similar to FIG. 4, but incorporating a plurality of insulating thin films.

In FIG. 5, a cross-sectional view appears through an embodiment of the invention similar to that set forth in FIG. 4. The skin 49 shown in FIG. 5 may thus once again represent a portion of an arc extending for example between a pair of shroud lines 59, 61 in FIG. 4. The embodiment shown in FIG. 5 differs from the prior view in that now a plurality of films 81, 83 are secured in parallel spaced fashion to the arc. The films 81, 83 are once again secured to the end line dividing the arc as for example by heat sealing such films to an anchor strip 85.

Anchor ties 87 secure the middle film 81 to the skin 79 by heat sealing along 91 and 89 respectively while anchor ties 86 secure the inner film 83 to anchor ties 87 via heat seals 93 and 91 respectively.

As in prior embodiments, the films 81 and 83 are extended in a relatively taut fashion across the concave surface of billowing, inflated skin 79. The anchor ties 86, 87 merely act as restraints along intermediate points of the film holding such intermediate protions in spaced fashion from the skin to thereby define a plurality of parallelapiped shaped dead air spaces 95 between the films 81, 83 and spaces 96 between the film 81 and skin 79.

Figure 6:
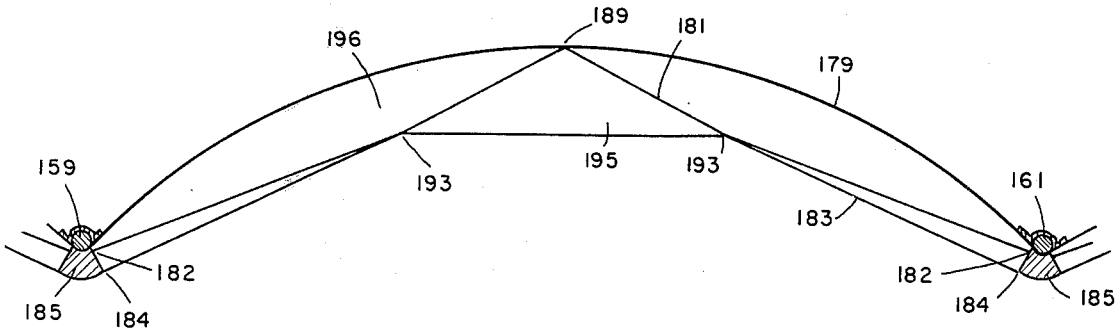
FIG. 6 illustrates an embodiment of the invention wherein distinct anchor tie elements are not used.

FIG. 6 illustrates an embodiment which achieves the objectives of the present invention without the use of distinct anchor tie elements. In this embodiment, the middle film 181 is secured to the anchor strips 185 along lines 182 and is heat sealed to the outer skin 179 along the line 189. The inner film 183 is secured to the anchor strips 185 along lines 184 and is heat sealed to the middle film along lines 193. In much the same manner as previously, as the positive air pressure inflates the air structure, the skin 179 billows outwardly from the restraining shroud lines 159, 161 and extends the middle and inner films in the relatively taut fashion shown. In this case, air spaces of triangular cross section 196 are created between the skin 179 and the middle film 181 while similarly shaped air spaces 195 are created between the middle and inner films.

While the present invention has been particularly set forth in terms of specific embodiments thereof, it will be understood in view of the present disclosure that numerous variations upon the invention are now enabled to those skilled in the art which variations in propriety yet reside within the scope of the present invention.

Thus it will be understood that the term "film" as used herein is not restricted to a homogeneous plastic sheet but may include any relatively impermeable, lightweight sheeting such as for example those formed of foamed plastics the surfaces of which may be sealed if necessary to provide the requisite permeability. Also encompassed within the term "film" are suitably impregnated lightweight fabrics. Accordingly, the invention is to be broadly construed and limited only by the scope and spirit of the claims now appended hereto.

I claim:

1. An air inflated shell-like structure for enclosing a volume of space therein, said structure having insulated walls which curtail heat flow from or into said enclosed volume, comprising:

a flexible outer skin defining the exterior shell of said structure;

means for providing positive air pressure within said enclosed volume of said structure for maintaining said skin in a fully expanded condition, the geometry of said skin being such that in said expanded condition, concavities are formed by said skin defining said shell wall; and a thin plastic film secured at the outer surface boundaries of said concavity, and secured to the shell wall within said boundary, said thin film being continuous across said boundary and the surface area of the film being less than surface of said concavity within said boundary, the space between said outer skin and thin plastic film communicating by openings in said plastic film with the said enclosed volume of said structure and being at the pressure of said enclosed volume, whereby said flexible outer skin is expanded by said positive pressure in said enclosed volume, whereby in the inflated structure, the said film is extended in taut fashion across the concavity to define an insulating air space between wall and film.

2. A structure according to claim 1 wherein said film is restrained within said boundary at points offset from said wall.

3. A structure according to claim 2 wherein said film is restrained by attaching said film to flexible anchor tie strips which are secured to the wall of said shell at intermediate points within said boundary.

4. A structure according to claim 3 including a plurality of said thin films, said films being in substantially parallel overlying relationship with one another whereby additional insulating air space is defined between said thin films.

5. A structure in accordance with claim 3 wherein said thin films comprise a thermoplastic material which is secured by heat sealing.

6. A structure according to claim 5 wherein said anchor ties comprise a thin thermoplastic material, said anchor ties being secured to said shell skin and to said thin film by heat sealing.

7. A structure according to claim 1, wherein said communication to said space between said skin and thin plastic film is enabled by perforations in said film for permitting air movement into and out of said air space.

8. A structure according to claim 1, further including a plurality of shroud lines drawn about the external wall of said shell skin for reducing strain in said structure, said concavities being defined by the billowing portions of said skin between successive shroud lines.

9. A structure according to claim 8, further including a plurality of film-shroud line anchor strips secured to the inner side of said shell skin and extending in parallel fashion with said shroud lines, said thin film being secured to said concavities by attachment thereof to the side of said film-shroud line anchor strips non-adjacent to said shroud lines.

10. A structure according to claim 9 wherein said film-shroud line anchor strip comprises a resilient plastic material.

11. A structure according to claim 10 wherein said thin film and anchor tie strips comprise a polyvinyl chloride film.

12. A structure according to claim 9 wherein said anchor tie strips comprise strips of flexible thermoplastic material, one edge of said strip being secured to said shell skin by heat sealing; the opposite edge of said strip being secured to said thin film by heat sealing.

13. A structure according to claim 12 wherein said anchor tie strips comprise polyvinyl chloride sheet material.

14. A method for insulating an air inflatable structure for enclosing a volume of space, said structure being of the type including a flexible fabric shell defined by a flexible outer skin, said shell possessing a geometry such that when said structure is inflated, said skin is expanded to define concavities at said shell interior, comprising:

securing a thin plastic film to said concavities of the interior wall of said shell by securing said thin film to the boundaries of said concavity and to points on said wall within said boundary, the area of said secured film being less than the area of said concavity; and providing by openings in said thin film a path of gas communication between the space defined between the said skin and thin plastic film and said enclosed volume of said structure, to enable pressure equalization between said enclosed volume and said space, whereby when said flexible outer skin is expanded by positive air pressure within to enable said inflation, the said film is stretched taut across the concavity to define an insulating air space between wall and film.

15. A method according to claim 14 wherein the said film is restrained at points offset from said wall by attaching the said film to flexible connecting means extending between said wall and said film.

16. A structure according to claim 1, further including at least a second thin film secured at said boundary at radial points which with respect to said concavity are inwardly displaced, said second film being continuous across said boundary and having a smaller surface area than said first film, and said second film being secured to said first film at intermediate points within said boundary, whereby in the inflated structure, said second film is drawn taut between said boundary and the points of securing to said second film to thereby define air spaces between said first and second films.

* * * * *